United States Patent [19]

Mitchelson

[11] 4,270,513

[45] Jun. 2, 1981

[54] FIREPLACE FLUE HEAT EXCHANGER AND CONTROL

[76] Inventor: Mark M. Mitchelson, 1046 Bond St., Neosho, Mo. 64850

[21] Appl. No.: 68,769

[22] Filed: Aug. 22, 1979

[51] Int. Cl.[3] ..... F24B 7/00

[52] U.S. Cl. ..... 126/121; 237/55; 110/162

[58] Field of Search ..... 126/120, 121, 122, 123, 126/143, 164, 131; 237/51, 55; 110/162

[56] References Cited

U.S. PATENT DOCUMENTS

| | | | |
|---|---|---|---|
| 2,274,341 | 2/1942 | Mueller | 126/121 |
| 2,277,381 | 3/1942 | Black | 126/121 |
| 3,094,980 | 6/1963 | Inabnit | 126/121 |

FOREIGN PATENT DOCUMENTS

| | | | |
|---|---|---|---|
| 7709614 | 4/1979 | Sweden | 237/55 |
| 1495696 | 12/1977 | United Kingdom | 237/55 |

*Primary Examiner*—James C. Yeung
*Attorney, Agent, or Firm*—Harvey B. Jacobson

[57] ABSTRACT

An open sided firebox is provided including an upwardly tapering upper bonnet portion. The lower end of an upstanding flue pipe opens downwardly into the interior of the bonnet portion and the upper end portion of the flue pipe is open for exhausting flue gases above the roof line of a building in which the firebox is disposed. A multi-walled outer housing encloses the firebox and includes a front wall having an opening therein through which the open side of the firebox opens. The upper portion of the housing tapers upwardly in cross section and encloses the bonnet. An upstanding flue liner is loosely disposed about the flue pipe and includes a lower end opening downwardly into the upper portion of the housing and an upper end sealed about the upper end of the flue pipe. Air pump structure is provided for pumping ambient air into the upper portion of the interior of the liner exteriorly of the flue pipe and at least one of the walls of the housing has outlet openings therein for exhausting heated air into a room of a building including a fireplace structure in which the housing is disposed, the flue liner passing upwardly through a flue structure provided therefor in the building to a point above the roof line thereof. In addition, second air pump structure is provided for pumping air upwardly through the flue pipe.

3 Claims, 3 Drawing Figures

FIREPLACE FLUE HEAT EXCHANGER AND CONTROL

BACKGROUND OF THE INVENTION

Because of the recent energy crisis, many home dwellers are becoming more reliant upon fireplaces to heat their homes, at least partially, during the winter months.

Existing fireplaces are capable of heating a room into which the fireplace opens to a reasonable extent, but most fireplaces "pull" draft air from the room into which the fireplace opens with the result that the air for supporting combustion within the fireplace and drawn into the latter must be replaced within the associated building. Accordingly, a slight negative pressure is generated by a fire burning within a fireplace and this negative pressure draws replacement air into the associated building through the many small passages through which air from the exterior of a building may pass into the interior thereof with the result that rooms distant from the room into which the fireplace opens become cooled by the air entering the building structure from the exterior thereof to replace the air "pulled" into the fireplace for draft purposes.

Although some fireplaces are equipped with exterior draft air ducts and some of these fireplaces include glass doors to prevent or substantially reduce the movement of air from within the associated building structure into the fireplace, fireplaces equipped with glass doors do not radiate as much heat into the associated room.

While a few fireplaces equipped with outside draft air ducts also include built-in heat exchanger structure within the fireplace, and thus increase the amount of heat available for heating the interior of the associated building, a need still exists for a more efficient manner of preventing ambient air from entering the interior of a building through the many small passages through which air from the exterior of a building may pass into the interior thereof. Also, even a fireplace with heat exchanger structure and glass doors exhausts a considerable amount of heat to the exterior of the associated building through the flue pipe thereof.

Examples of various forms of fireplace heat exchanger structures including some of the general structural and operational features of the instant invention are disclosed in U.S. Pat. Nos. 311,313, 553,750, 2,277,381, 2,348,834, 2,361,644, 2,481,861 and 3,724,443. However, these previously known structures are not as efficient as they could be for the purpose of providing maximum heat to the interior of an associated building while burning a minimum amount of fuel.

BRIEF DESCRIPTION OF THE INVENTION

The fireplace heat exchanger of the instant invention is of the open front type and need not be provided with glass closure doors. Further, the heat exchanger of the instant invention pumps ambient air into the heat exchanger for heating therein and then discharges the heated air into the room into which the fireplace opens. The volume of air pumped into the heat exchanger from the exterior of the associated building is greater than the volume of air needed to support combustion of fuel within the fireplace, with the result that instead of a fire in the fireplace creating a negative pressure within the associated building, a positive pressure is formed within the associated building. In this manner, substantially all passages for air to leak into the building from the exterior thereof, at least during calm weather, are blocked, by the greater pressure within the building, against the entrance of cool air into the building.

The heat exchanger portion of the fireplace initially pumps ambient air into a prewarming chamber surrounding the upper portion of the flue pipe for the fireplace and thus extracts a considerable amount of heat from the flue gases which normally pass upwardly through the flue pipe. The prewarmed air within the inlet portion of the heat exchanger about the flue pipe is thus warmed to a temperature greater than the temperature within the associated building structure before passing into the main portion of the heat exchanger disposed immediately about the firebox in which the fire is being burned. In this manner, the temperature of the air ultimately discharged from the heat exchanger is considerably greater than the temperature of air discharged from conventional fireplace heat exchanger structures and the heated air is discharged from the heat exchanger at a rate greater than the rate of movement of flue gases up the flue pipe from the firebox. Thus, the fireplace heat exchanger of the instant invention does not require the utilization of glass fireplace doors and may further realize a greater percentage of heat radiated into the associated room through the open front of the fireplace.

The main object of this invention is to provide a fireplace heat exchanger constructed in a manner to obtain the maximum amount of heat exchange from a fire being burned in the associated fireplace.

Another object of this invention is to provide a fireplace heat exchanger constructed in a manner which will prevent air leakage into the associated building from the exterior thereof due to a negative pressure within the building.

Still another important object of this invention is to provide a fireplace which does not require glass doors.

Another very important object of this invention is to provide a heat exchanger including automatic controls for the air pump structure utilized to pump air through the heat exchanger.

A final object of this invention to be specifically enumerated herein is to provide a fireplace heat exchanger which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
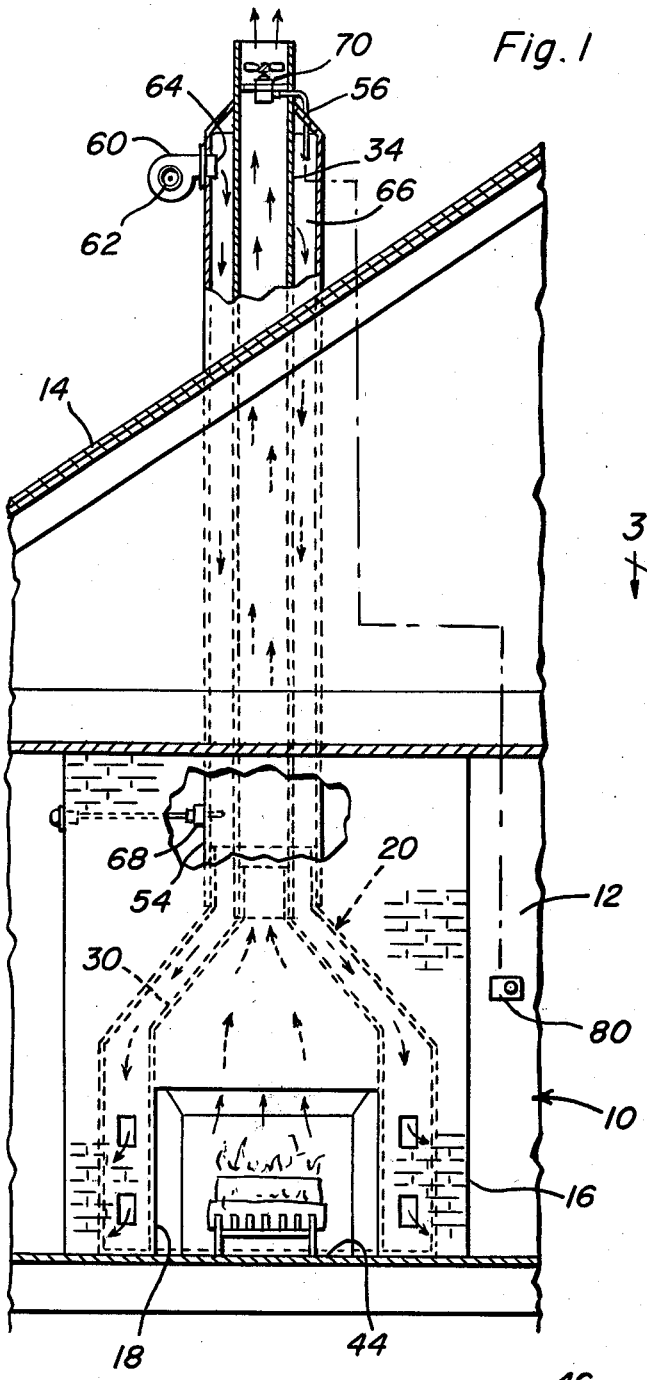
FIG. 1 is a fragmentary, vertical sectional view of a building structure having a fireplace opening into a room within the building structure and with the heat exchanger of the instant invention operatively associated with the fireplace.
Figure 2:
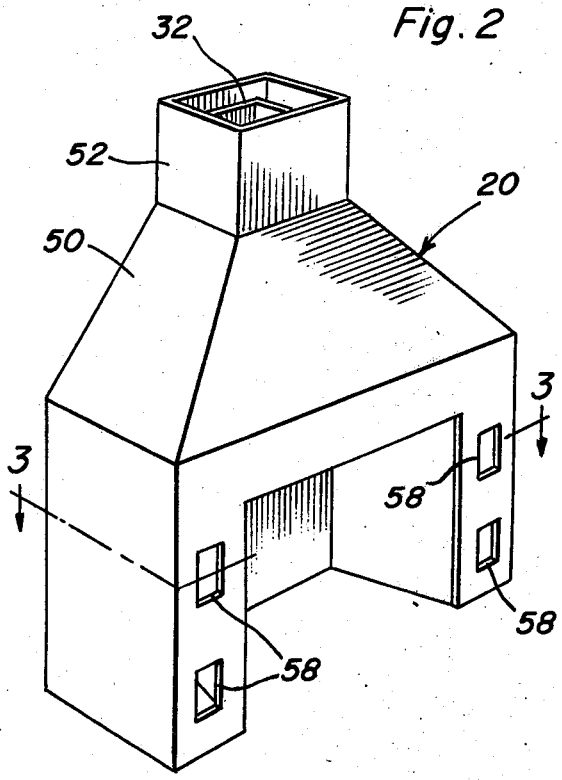
FIG. 2 is a perspective view of the main heat exchanger portion of the invention.
Figure 3:
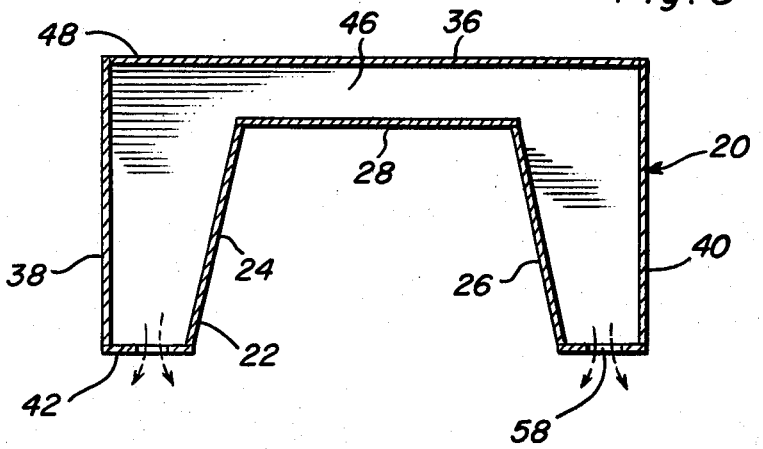
FIG. 3 is an enlarged horizontal sectional view taken substantially upon the plane indicated by the section line 3—3 of FIG. 2.

Referring now more specifically to the drawings, the numeral 10 generally designates a building structure of conventional design including an interior room 12 and a roof structure 14. A fireplace 16 is disposed in the room 12 and includes an opening 18 which opens into the room 12.

The heat exchanger of the instant invention is referred to in general by the reference numeral 20 and includes an open sided firebox 22 including opposite side walls 24 and 26 and a rear wall 28. The firebox 22 is closed at its upper portion by an upwardly tapering bonnet portion 30 and the upper extremity of the bonnet portion 30 terminates in an upwardly opening outlet 32 over which the lower end of a flue pipe 34 is sealingly telescoped. The flue pipe 34 extends upwardly through the roof structure 14.

The firebox 22 is enclosed within a hollow housing 36 including opposite side walls 38 and 40 and a front wall 42. In addition, although the lower portion of the firebox 22 may be left open and effectively closed by the hearth 44 of the fireplace 16, the open bottom of the firebox 22 may be closed by a closure wall (not shown) similar to the closure wall 46 closing the bottom of the housing 36, the closure wall 46 extending between the side walls 24, 38, 26, 40 and also between the rear wall 28 of the firebox 22 and the rear wall 48 of the housing 36.

The upper portion of the housing 36 tapers upwardly as at 50 and terminates upwardly in an upwardly opening outlet 52 over which the lower end of a flue liner 54 is sealingly telescoped. The flue liner loosely receives the flue pipe 34 therein and the upper end of the liner 54 is closed, as at 56, about the upper end of the flue pipe 34.

The front wall 42 of the housing 36 includes outlet openings 58 formed therein and the upper portion of the liner 54, above the roof structure 14, includes air blower structure 60 including an inlet 62 for ambient and an outlet 64 opening into the interior of the liner 54 exteriorly of the flue pipe 34. Accordingly, the air blower structure 60 is operative to pump ambient air into the upper portion of the space 66 between the flue pipe 34 and the flue liner 54, downwardly into the upper portion 50 of the housing 36 which loosely encloses the bonnet portion 30 and then downwardly into the lower portion of the interior of the housing 36 disposed about the firebox 22 and outwardly to through the openings 58.

A thermostat 68 is provided interiorly of the lower end of the liner 54 and is electrically connected to the blower structure 60 for actuation thereof at any time the temperature within the liner 54 exteriorly of the pipe 34 exceeds a predetermined temperature such as 100° F. Also, the upper end of the flue pipe 34 is provided with an exhaust blower 70 and the exhaust blower 70 may be under the control of a thermostat 74 within the room 12.

The air blower structure 60, for example, may have a capacity of 700 cubic feet per minute at $\frac{1}{8}$ inch static pressure and the blower 70 may have a capacity of 240 cubic feet per minute at $\frac{1}{2}$ inch static pressure. In this manner, the blower 70 is capable of lifting the draft air upwardly through the flue pipe 34, but at a lower flow rate than the flow rate of the air blower structure 60. Thus, when both the air blower structure 60 and blower 70 are operating, the interior of the building structure 10 will experience a positive pressure. Thus, air from the exterior of the building 10 may not leak thereinto through the various cracks and spaces between adjacent components of which the building structure 10 is constructed. Further, the heat exchanger does not require the utilization of a glass front and the ambient air pumped into the upper portion of the liner 54 is warmed to approximately 300° F. by the approximately 700° F. temperature of the flue gases being pumped upwardly through the flue pipe 34. In cool weather, when the ambient air is not too cold and yet a fire is desired within the fireplace 16 to warm the interior of the building structure 10, it may not be necessary for the blower 70 to be operated, inasmuch as the temperature of the ambient air being pumped downwardly to the liner 54 exteriorly of the flue pipe 34 will not be so low as to effect a rapid transfer of heat from the flue gases through the flue pipe 34 to the air being pumped downwardly through the liner 54. Under such conditions, natural convection currents may be sufficient to provide ample draft for the fireplace 16. However, in colder weather transfer of heat through the flue pipe (non-insulative) to the air being pumped downwardly through the liner 54 may lower the temperature of the flue gases within the flue pipe 34 sufficiently to require operation of the blower 70. Further, the blower 70 is under the control of the room thermostat 80 and is actuated in response to a drop in temperature within the room 12 so as to increase the draft air into the firebox 22.

Of course, the outlet 32 may be provided with suitable damper structure and the outlet of the air blower structure 60 may be provided with a spring biased flap valve (not shown) in order to prevent uncontrolled flow of cool air through the air blower structure 60, downwardly through the liner 54 and into the room 12 through the openings 58.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fireplace heat exchanger and control for installation in a fireplace and the fireplace flue, said heat exchanger including means defining an open sided firebox including an upwardly tapering upper bonnet portion, an upstanding flue pipe including a lower end opening downwardly into the interior of said bonnet portion and an upper end portion for projecting above the roof line of a building containing said fireplace, a multi-walled outer housing enclosing said firebox and including a front wall having an opening therein through which said open side of said firebox opens, the upper portion of said housing tapering in transverse cross section and loosely enclosing said bonnet therein, and an upstanding flue liner loosely receiving said fire pipe therein, including a lower end opening downwardly into said upper portion of said housing and also including an upper end sealed about the upper portion of flue pipe, first air pump means for pumping ambient air into the upper portion of the interior of said liner exteriorly of said flue pipe, downwardly through said liner about said flue pipe and into the interior of said housing upper portion, at least one of the walls of said housing having outlet openings therein for exhausting heated air from said housing into a room of said building, said fireplace heat exchanger being enclosed within a fireplace structure including an upwardly extending flue passage through which said liner extends, first thermostat controlled actuating structure for said first air pump means and operative to actuate said air pump means in response to a rise in the temperature air passing downwardly through a lower portion said flue liner exteriorly of said flue pipe above a predetermined temperature, second air pump means operatively associated with said flue pipe for pumping flue gases upwardly therethrough, the first air pump means having a greater capacity for pumping air than the second air pump means, a control assembly for actuating said second air pump means, said control assembly including a room thermostat operative to actuate said second air pump means responsive to the temperature of room air dropping below a predetermined temperature, said first air pump means having a higher operational airflow capacity rating than the operational airflow capacity rating of said second air pump means.

2. The combination of claim 1 wherein said one wall of said housing comprises the front wall thereof.

3. The combination of claim 2 wherein said fireplace heat exchanger is enclosed within a fireplace structure including an upwardly extending flue passage through which said liner extends.

* * * * *